United States Patent [19]

Baumann et al.

[11] 4,265,277

[45] May 5, 1981

[54] WEAVING MACHINE HAVING NOISE ATTENUATING MEANS

[75] Inventors: Heinz Baumann; Charles Caille, both of Winterthur, Switzerland

[73] Assignee: Sulzer Brothers Ltd., Winterthur, Switzerland

[21] Appl. No.: 959,477

[22] Filed: Nov. 13, 1978

[30] Foreign Application Priority Data

Nov. 17, 1977 [CH] Switzerland ..... 14038/77

[51] Int. Cl.[3] ..... D03D 49/00; G10K 11/16

[52] U.S. Cl. ..... 139/1 R; 139/1 C

[58] Field of Search ..... 139/1 R, 1 C; 19/205; 28/172, 173; 181/198

[56] References Cited

U.S. PATENT DOCUMENTS

| | | | |
|---|---|---|---|
| 1,631,088 | 5/1927 | Davis | 139/1 C |
| 3,692,065 | 9/1972 | Saul | 139/1 C |
| 4,074,725 | 2/1978 | Bader et al. | 139/1 R |
| 4,088,157 | 5/1978 | Chen et al. | 139/1 R |

FOREIGN PATENT DOCUMENTS

| | | | |
|---|---|---|---|
| 199544 | 6/1923 | United Kingdom | 139/1 C |

*Primary Examiner*—Henry Jaudon
*Attorney, Agent, or Firm*—Kenyon & Kenyon

[57] ABSTRACT

Transparent plastic cover curtains are suspended from rods at the warp beam and cloth beam ends of the weaving machine. The curtains are of multi-part construction to allow lifting of individual parts to gain access to the machine parts, the warp beam and the cloth beam. The curtains allow the warp and cloth beams to be included in the air paths to an air cleaning duct.

9 Claims, 5 Drawing Figures

WEAVING MACHINE HAVING NOISE ATTENUATING MEANS

This invention relates to a weaving machine and, more particularly, a weaving machine having noise attenuating means.

Heretofore, it has been known to provide weaving machines with air ducts and covers in order to clean dust, lint and the like from the instrumentalities of the machine. In one case, such as described in U.S. Pat. No. 3,391,528 a top cover is used to cover a part of a weaving machine. However, this cover extends inside the warp and cloth beams at the bottom of the machine in order to ensure access to these beams from the outside. As a result, the warp and cloth beams are excluded from the air ducts. Other types of covers for attenuating noise in a weaving machine have also been known from U.S. Pat. No. 4,074,725.

It is an object of this invention to provide a weaving machine having air cleaning ducts with noise attenuating means which cover the warp and cloth beams while permitting access to these beams.

It is another object of the invention to provide a noise attenuating curtain for a warp beam/cloth beam of a weaving machine which can be mounted in place in a relatively easy manner.

It is another object of the invention to provide a noice attenuating curtain for the warp and cloth beams of a weaving machine that can be easily opened for access to the beams.

Briefly, the invention provides a weaving machine having a warp beam end and a cloth beam end with a freely suspended cover curtain on at least one of these ends. In addition, a cover and associated air cleaning ducts are disposed over a weaving plane between the two ends of the machine to attenuate noise and to carry off lint, dust and other foreign particles.

The curtain allows the warp and cloth beams to be included in the air paths and yet accessibility of these two beams is maintained. On a change of warp and cloth beams only the relevant curtain has to be lifted or folded up, and this is a simple matter.

In one embodiment, the curtain is of multi-part construction on one side so that individual parts can be moved or lifted for overhaul and/or for the passage of machine parts situated behind the same, e.g. flanges of a multi-part warp beam.

The curtain is mounted by a suspension device which is located at a respective end of the machine such that the curtain is suspended in the plane to extend loosely to the outside of a beam. In this way, the curtain remains on the circumference of the beam under gravity during variance of the beam diameter or reaches a vertical position and hangs down without physical contact under its own weight when the beam diameter decreases a sufficient extent.

FIG. 1 diagrammatically illustrates a weaving machine according to the invention viewed from the cloth side;

Figure 1:
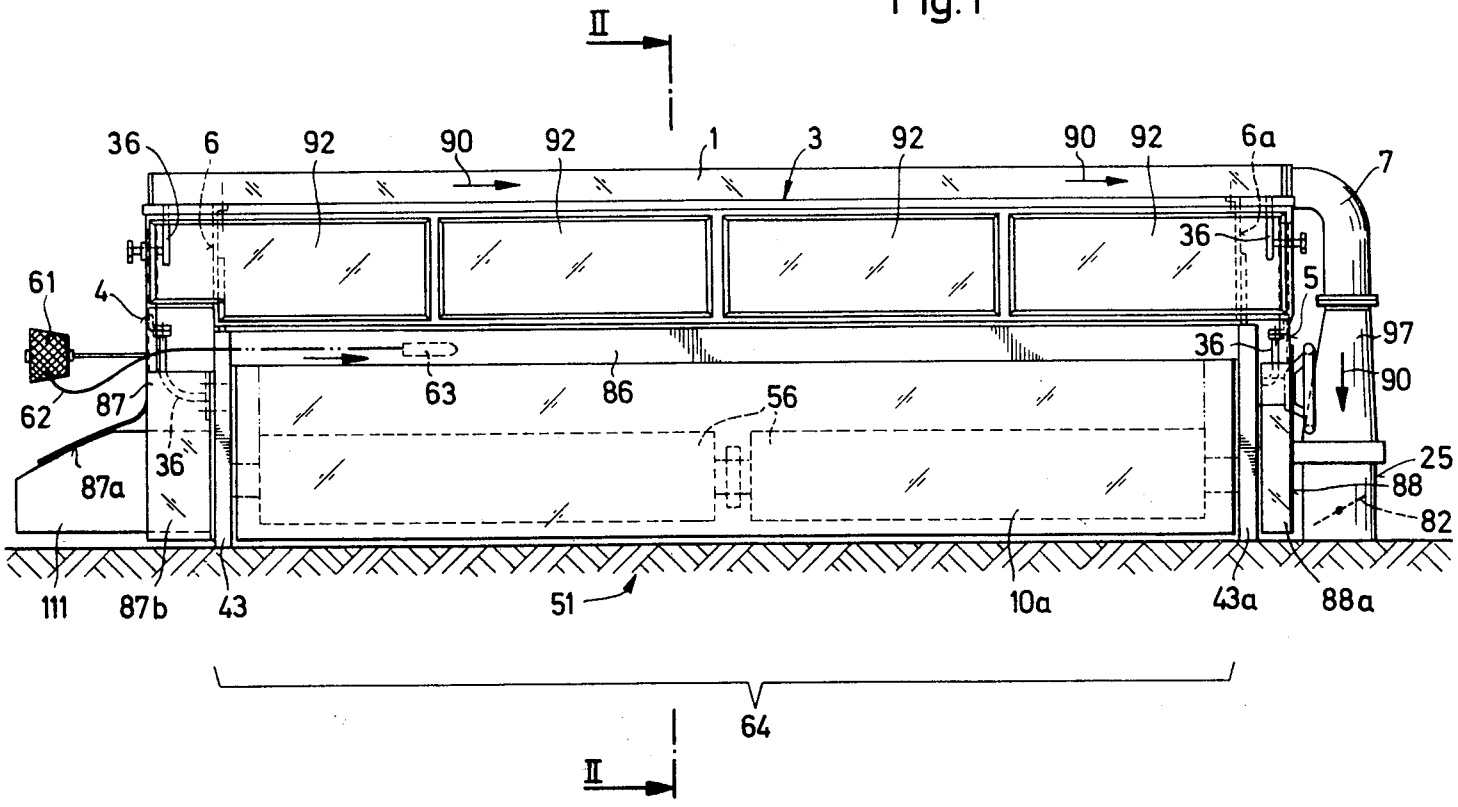
Figure 2:
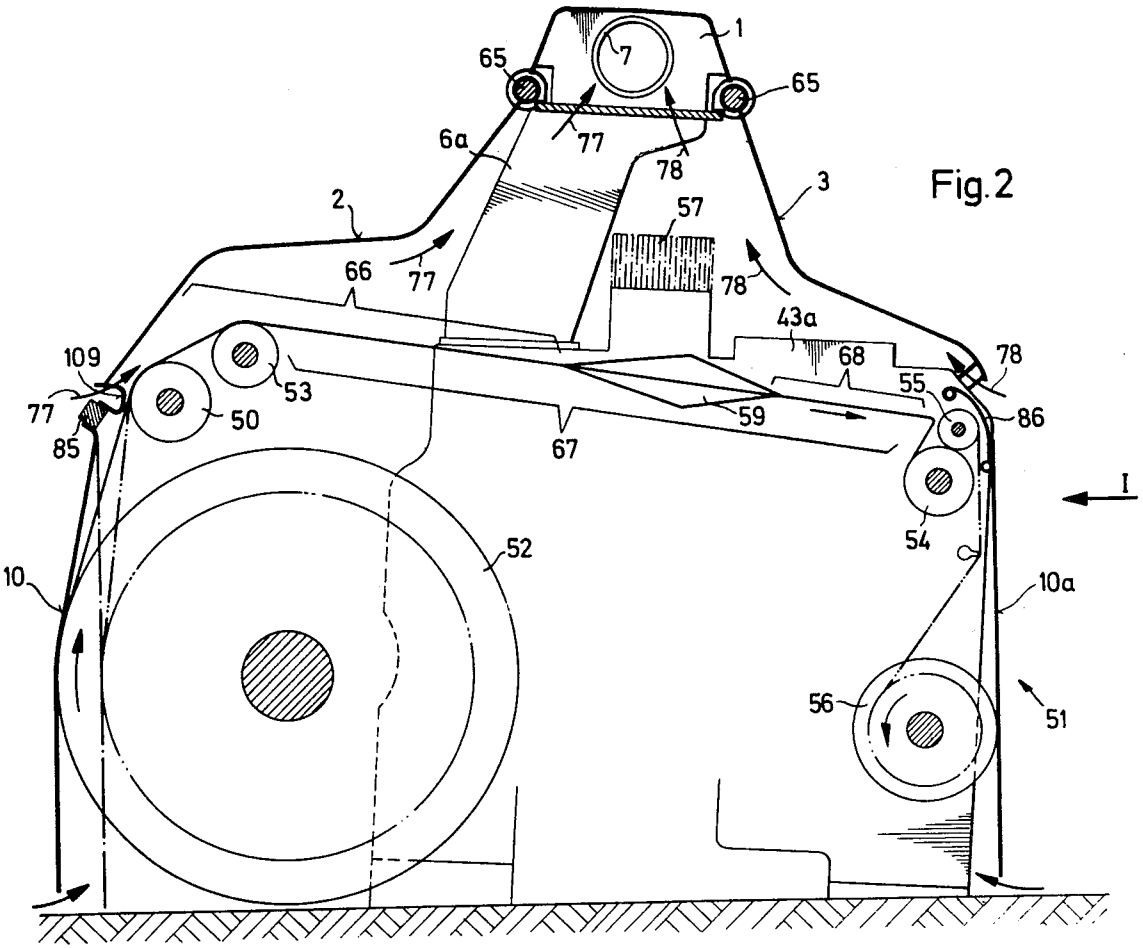
FIG. 2 illustrates a view taken on line II—II of FIG. 1 to an enlarged scale.

Referring to FIG. 1, the weaving machine 51 has a frame of generally conventional structure including two side members 43, **43*a* which are disposed at a picking side and a catching side, respectively. In addition, as shown in FIG. 2, the weaving machine 51 has a warp beam end at which a warp beam 52, a deflector beam 50 and a tensioning beam 53 are located as well as a cloth beam end at which a cloth take-up beam 54, a presser roller 55, and a cloth beam 56 are located. Also, a shedding mechanism, for example composed of shafts 57 is provided between the warp beam end and cloth beam end in order to form a shed 59 of warp yarns which are delivered from the warp beam 52. As shown in FIG. 1, a weft yarn supply bobbin 61 is located near the picking side of the machine in order to introduce a weft yarn 62 into the shed, for example by means of a gripper projectile 63. As indicated, the weft yarn 62 is movable through a weft path in a weaving plane 67 from the picking side to the catching side of the machine. As shown in FIG. 2, the weaving plane 67 extends from the tensioning beam 53 to the take-up beam 54 while a warp zone 66 of the weaving plane extends from the deflector beam 50 to the shed 59 and a cloth zone 68 extends from the shed 59 to the take-up beam 54**.

Referring to FIGS. 1 and 2, an air duct 1 extends parallel to the weft path above the weaving plane 67 and substantially above the shafts 57 over the entire width 64 of the weaving machine. This duct 1 serves to discharge fly dust, lubricant mist, and the like. As shown, the duct 1 is mounted on two members 6, **6*a* which are, in turn, fixed on the side members 43, 43*a*** of the weaving machine.

In addition, a pair of cover flaps 2, 3, for example of "Plexiglass" (acrylic glass), are hinged on the air duct 1 by means of hinges 65. Each flap 2, 3 extends from the duct 1 to cover at least a part of the weaving plane 67. As indicated, one flap 2 extends over the warp zone 66 while the other flap 3 substantially covers the cloth zone 68.

A relatively intense suction action can be obtained in the zones beneath the duct 1 and the flaps 2, 3. Fly dust is thus extracted in a very effective manner and passes in the direction indicated by the arrows 77, 78 at a relatively high speed into the air duct 1 through openings therein. As indicated in FIG. 1, the air entrained foreign matter exhausts via a bend 7 and an extraction line 97 as indicated by an arrow 90 past a control flap 82, a fan (not shown) and filters, if required, to the atmosphere or other exhaust point.

As shown in FIG. 1, each side of the machine 51 may be provided with two cover plates 4, 5 which are fixed on members 36. In addition, a curtain 10 consisting, for example of a transparent readily lifted plastic sheeting, is provided at the warp end on a rod 85 which is easily removable from the machine 51, e.g. by means of a screw or plug-in connection. A corresponding curtain **10*a* is provided at the cloth end on a breast plate 86 of the weaving machine 51. A curtain 87 is provided on the picking side and a curtain 88 is provided on the catching side (FIG. 1). The curtains 10*a*, 10, 87, 88 hang down freely, i.e. are freely suspended, and are not guided at the edges but are simply fixed at the top so as to be readily lifted to provide access to the machine. The curtains 10, 10*a*, 87, 88 together with the cover flaps 2, 3** define a continuous hood over the machine to attenuate the noise emitted by the weaving machine.

The rod 85 acts as a suspension device for the curtain 10 and is located at the warp beam end of the weaving machine 51 to suspend the curtain 10 in the plane of the warp beam 52 so that the curtain 10 extends over the outside of the warp beam 52 and remains on the circumference of the warp beam 52 under gravity during variance of the beam diameter.

Figure 3:
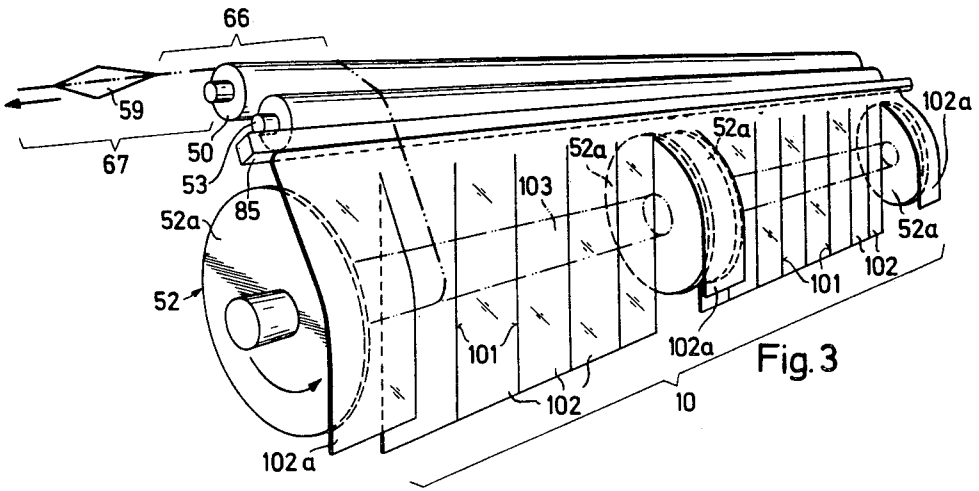
FIG. 3 illustrates a perspective view of a multi-part curtain over a multi-part warp beam of depleted content in accordance with the invention.

Referring to FIG. 3, the warp beam 52 is of two-part construction. The curtain 10 is made of multi-part construction by being cut at various points to contain a relatively large number of flaps 102. Some of the flaps 102*a* hang over the warp beam flanges 52*a* to provide a relative seal-tight covering in this zone. When the winding 103 on the warp beam reduces to a small diameter, the flaps 102 hang substantially vertically in the region between the flanges 52*a* as a result of the weight of the curtain.

Figure 4:
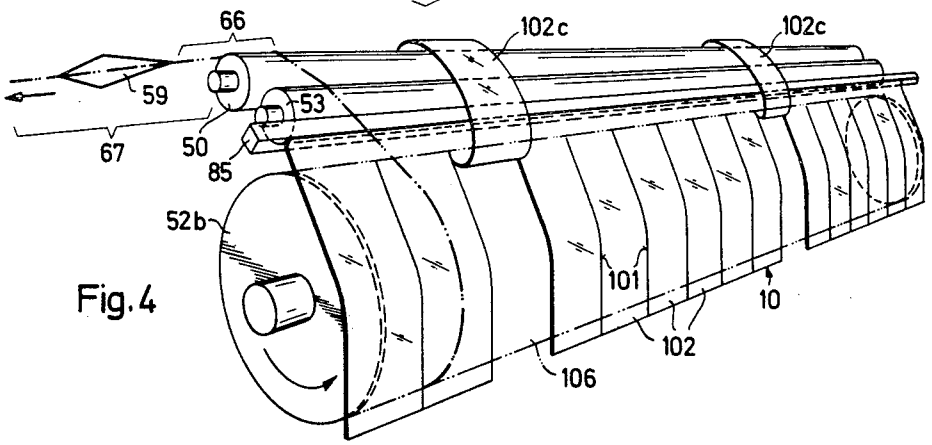
FIG. 4 illustrates a perspective view of a multi-part curtain over a one-piece warp beam of full content in accordance with the invention.

Referring to FIG. 4, a one-piece warp beam 52*a* is used with a large diameter for a winding 106. As shown, two flaps 102*c* are lifted or folded up so that the winding 106 is readily accessible at these points.

Figure 5:
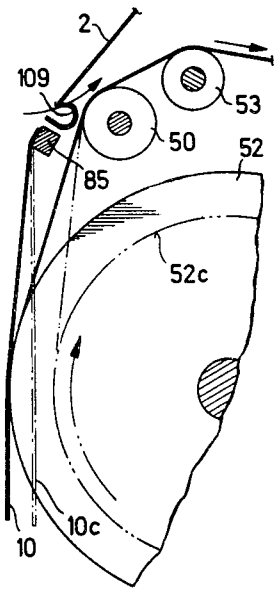
FIG. 5 illustrates a side view of a curtain against a warp beam in accordance with the invention.

Referring to FIG. 5, when the diameter of the winding on the warp beam 52 has decreased, for example, to the indicated circumference 52*c*, the curtain 10 reaches a vertical position 10*c*, and hangs down without physical contact under its own weight. As shown, the curtains 10, 10*a* extend to points near the floor on which the machine frame is supported to define small gaps through which air may be drawn into the interior of the machine frame.

The curtain 10*a* on the cloth beam end is of similar construction and is mounted in the same manner as the curtain 10 on the warp beam end also to the outside of the cloth beam 56 relative to the interior of the machine frame. Like the curtain 10, 10*a* on the warp and cloth ends, the curtain 87 on the weft side can also be divided for example, e.g. cut, and have a part 87*a* hanging over the shaft drive 111. FIG. 1 also shows a curved curtain part 87*b*, adjacent the viewer, whereby a transition is provided between the curtain 87 and the member 43. A relatively seal-tight cover is thus obtained at the end of the machine. The curtain 88 on the catching side is correspondingly provided with a curved end 88*a* extending as far as the member 43*a*.

One or more curtains can be disposed, for example, on a top frame extending around the entire weaving machine. Conditioned air can also be supplied via the air duct 1, for example, and be discharged if required through a bottom duct disposed, for example, between the warp beam 52 and the cloth beam 56.

What is claimed is:

1. A weaving machine supported on a floor and having a warp beam end, a cloth beam end, a cover over a weaving plane between said ends to attenuate noise, a suspension device located at one of said ends and a curtain freely suspended from said suspension device at said one end to extend loosely along an outer side of a beam at said end and extending to points near the floor, said curtain being of multi-part construction to define a plurality of flaps to permit lifting to provide access to the machine.

2. A weaving machine as set forth in claim 1 which has a freely suspended curtain at each of said ends.

3. A weaving machine as set forth in claim 1 wherein said curtain is of multi-part construction whereby individual parts can be moved to provide access to the machine.

4. A weaving machine as set forth in claim 1 which further comprises means for removably mounting said suspension device in said machine.

5. In combination with a weaving machine having a frame, a warp beam mounted at one end of said frame and a cloth beam mounted at an opposite end of said frame;

a curtain freely suspended from said frame at one of said ends to attenuate noise from said machine at said one end, said curtain extending loosely along an outer side of said beam at said one end of said frame relative to the interior of said frame, said curtain being of multi-part construction to define a plurality of flaps to permit lifting to provide access to said interior.

6. The combination as set forth in claim 5 wherein said curtain is of multi-part construction to permit movement of individual parts thereof for access to said one end of said frame.

7. The combination as set forth in claim 6 which further comprises a second multi-part curtain suspended from said frame at the other of said ends of said frame, said second curtain extending loosely along an outer side of said beam at said opposite end of said frame relative to the interior of said frame.

8. The combination as set forth in claim 7 which further comprises a cover over a weaving plane between said ends to attenuate noise, said cover and said curtains defining a substantially continuous hood over said weaving machine.

9. A weaving machine supported on a floor and having a warp beam end, a cloth beam end, a suspension device located at one of said ends, a cover over a weaving plane between said ends to attenuate noise said cover having a flap with a free end bearing on said suspension device and a curtain freely suspended from said suspension device at said one end to extend loosely along an outer side of a beam at said end and extending to points near the floor.

* * * * *

UNITED STATES PATENT AND TRADEMARK OFFICE

CERTIFICATE OF CORRECTION

PATENT NO. : 4,265,277

DATED : May 5, 1981

INVENTOR(S) : HEINZ BAUMANN, ET AL

It is certified that error appears in the above—identified patent and that said Letters Patent is hereby corrected as shown below:

Column 1, line 51, after "suspended" delete"in the plane"

Column 1, line 52, change "outside" to --outer side--

Signed and Sealed this

*Eighteenth* Day of *August 1981*

[SEAL]

*Attest:*

GERALD J. MOSSINGHOFF

*Attesting Officer*

*Commissioner of Patents and Trademarks*